United States Patent [19]

Atlas

[11] 4,443,515

[45] Apr. 17, 1984

[54] ANTISTATIC FABRICS INCORPORATING SPECIALTY TEXTILE FIBERS HAVING HIGH MOISTURE REGAIN AND ARTICLES PRODUCED THEREFROM

[75] Inventor: Sheldon M. Atlas, New York, N.Y.

[73] Assignee: Peter Rosenwald, New York, N.Y.

[21] Appl. No.: 461,514

[22] Filed: Jan. 27, 1983

[30] Foreign Application Priority Data

Feb. 5, 1982 [FR] France ..... 82 01861
Aug. 20, 1982 [FR] France ..... 82 14409

[51] Int. Cl.[3] ..... D03D 25/00

[52] U.S. Cl. ..... 428/224; 156/275.5; 264/178 F; 264/184; 264/210.2; 264/210.8; 428/217; 428/253; 428/288; 428/296; 428/299; 428/300; 428/364; 428/365; 428/394; 428/500; 428/913; 428/922

[58] Field of Search ..... 428/299, 300, 301, 364, 428/365, 394, 500, 234, 235, 253, 280, 288, 91, 908.8, 913, 922, 296; 264/22, 184, 178 F, 236, 210.2, 210.8, 331.18; 156/275.5

[56] References Cited

U.S. PATENT DOCUMENTS 3,779,853 12/1973 Olson .
3,801,553 4/1974 Yamaguchi et al. ..... 264/178 F
3,855,382 12/1974 Takeya et al. ..... 264/178 F
4,017,653 4/1977 Gross ..... 264/331.18
4,163,078 7/1979 Reinehr et al. ..... 264/178 F
4,303,607 12/1981 De Maria et al. ..... 264/178 F
4,336,345 6/1982 Leuro et al. ..... 428/365
4,347,203 8/1982 Mimura et al. .
4,377,648 3/1983 Menault et al. ..... 264/178 F
4,399,091 8/1983 Eisenstein et al. ..... 264/178 F

*Primary Examiner*—James J. Bell
*Attorney, Agent, or Firm*—Sherman & Shalloway

[57] ABSTRACT

Woven, non-woven and knitted fabrics containing at least 1% by weight of specialty fibers formed from high molecular weight polymers of alpha, beta-ethylenically unsaturated aliphatic carboxylic acids, alpha, beta-ethylenically unsaturated aliphatic sulfonic acids and the hydroxyalkyl esters and glycidyl esters of these acids which are cross-linked at a cross-linking density of from about 1 cross-linkage per from about 40 to about 100 repeating monomeric units of the homopolymer are capable of absorbing up to about 40% by weight of the moisture without loss of mechanical strength and other textile properties. These fabrics have anti-static properties. Sheer fabrics are useful for stockings, panty hose, underwear and the like.

17 Claims, No Drawings

ANTISTATIC FABRICS INCORPORATING SPECIALTY TEXTILE FIBERS HAVING HIGH MOISTURE REGAIN AND ARTICLES PRODUCED THEREFROM

This invention relates to antistatic, comfortable and abrasion resistant fabrics suitable for the production of ladies undergarments, stockings, panty hose and the like. More particularly, this invention relates to such fabrics which incorporate specialty textile fibers which are fabricated from cross-linked high molecular weight linear hygroscopic polymers which specialty fibers are capable of absorbing large quantities of moisture without degradation of the textile properties of the fibers.

It is known to manufacture sheer fabrics from many kinds of fibers, such as silk, nylon, polyester and the like. These sheer fabrics are used in many types of garments, especially undergarments such as underpants, undershirts, stockings, panty hose, and the like.

In attempts to improve the properties of these articles of clothing made from sheer knitted fabrics, there have been modifications in the structure of the fibers such as monofilaments down to 7 denier per filament, multilobal cross-sections, bicomponent filaments and substitution of non-woven fabrics for the knitted fabrics. In spite of these exhaustive efforts, all of the presently existing textile fibers used in the production of sheer fabrics for use in such articles of clothing as ladies' undergarments, stockings, panty hose and the like, still suffer from several shortcomings. For instance, these fabrics still tend to be clammy, uncomfortable, sticky to the skin and exhibit a tendancy to develop static charges. Research in this area has shown that these shortcomings originate, at least in part, from insufficient moisture absorptivity of the fibers from which the textile goods are made. Accordingly, there have been many attempts to improve the moisture absorption properties of textile fibers.

It is known, for example, to graft acrylic and methacrylic acids onto nylon textile filaments with the aid of irradiation activation of the polyamide filament surface. As another approach, acrylic fibers have been developed which have a moisture absorptivity of around 15% due to the formation of a system of fine capillaries produced during the spinning of the filaments. Still another development is the production of modified polyester filaments for ladies' underwear in which the moisture absorptivity of the polyester has been increased up to about 15% by a partial sulfonation of the aromatic part of the macromolecule.

Still another method for increasing the overall absorptivity of these types of fabrics is the addition of a more highly absorbing fiber during the manufacturing process. Typical moisture regains of some conventional fibers made from various natural, artificial and synthetic fibers, as reported by R. W. Moncrief in Man-Made Fibers, 6th Edition, (1975) page 324, are shown in the following table

| Fiber | Regain (%) |
|---|---|
| Wool | 16 |
| Nylon | 4.0 |
| Polyester | 0.4 |
| Acrylic | 0.9 |
| Cotton | 8.5 |
| Viscose | 12.0 |

-continued

| Fiber | Regain (%) |
|---|---|
| Cellulose acetate | 6.5 |

Fabrics containing from 1 to 100% of fibers formed of amine-containing polymers which are cross-linked by a poly- or di-functional alkylating agent are described in U.S. Pat. No. 3,140,265 to Richter, et al., assigned to Rohm & Haas Co., as being characterized by resistance to development of static electricity and by desirable dyeing and moisture regain properties. The fibers may be composed of 50 to 100 mole percent of at least one monomer selected from the group consisting of methyl acrylate, ethyl acrylate, acrylamide, methacrylamide, N-alkyl-substituted acrylamide, and acrylonitrile.

Acrylic fibers with improved hydrophilicity and antistatic properties in balance with the physical properties such as knot strength and elongation are suggested for incorporation in underwear in U.S. Pat. No. 3,733,386 to Shimoda, et al., assigned to American Cyanamid Co. These acrylic fibers are produced from polymers containing at least 80% by weight of acrylonitrile and a copolymerizable monomer by treating the acrylic fiber while in a stretched swollen wet-gel state with a cross-linking agent, hydrolyzing the cross-linked wet-gel fiber with a mineral acid, optionally treating the hydrolyzed, cross-linked, wet-gel fiber with an aqueous solution of an ammonium or metal salt, and drying the fiber. The optional treatment with the aqueous salt solution imparts antistatic properties to the fibers. According to the examples in this patent, moisture regain values of only up to about 15% are achieved. Furthermore, only when the optional treatment with the aqueous salt solution was performed was it possible to have a surface resistance of less than $10^{10}$ ohms, which is the generally accepted maximum value for eliminating undesirably high static charge accumulation.

Yamamoto, et al in U.S. Pat. Nos. 3,626,049, 3,759,849 and 3,846,386 disclose cross-linked acrylic fibers, consisting predominantly of acrylonitrile, having hot-water resistance and a silky hand or feel and woven or knitted fabrics produced therefrom. These fibers are produced by heat-treating, to effect cross-linking, of fibers obtained by extruding an acidic solution of a copolymer obtained by copolymerizing in an acidic medium (a) a vinyl monomeric material consisting mainly of acrylonitrile and (b) a monomer having a halogenated s-triazinyl or halogenated pyrimidinyl group in the presence of (c) a polymerizable unsaturated monomer and/or (d) protein.

Crosslinked fibers and filaments of acrylonitrile copolymers to improve dimensional stability are described in U.S. Pat. No. 4,131,724 to Radlmann, et al. According to this patent, an acrylonitrile copolymer containing at least 20 m Val of carboxyl groups per kg of polymer is dissolved in a polar solvent with at least one polyoxazoline at a temperature of from 20° to 120° C. and the solution is spun into filaments. Cross-linking is thereafter effected by heating the filaments to a temperature of from 120° to 190° C. to react the carboxyl groups with the oxazoline rings to form ester and amide structures. However, in order to arrive at a satisfactory condition with respect to comfort, antistatic properties, and the like, it has been established in extensive studies that it is necessary to add a substantial amount, i.e. between 15 and 30%, of a hydrophilic fiber having a regain of at least about 8% to a hydrophobic fiber with a low regain of about 2%. Such relatively large additions of the hydrophilic component, however, lead to various adverse effects, including degradation of the modulus of elasticity, tensile strength, suppleness, and creep characteristics.

It is, therefore, an object of the present invention to provide light weight fabrics which may be woven, non-woven or knitted and which can be used to prepare articles of apparel which contact the human body, especially ladies' undergarments, including underwear, stockings, panty hose and the like which have antistatic properties, are comfortable and abrasion resistant.

A further object of the invention is to provide specialty fibers for textile applications wherein it is necessary to be able to absorb large quantities of moisture without degradation of tensile strength and other fiber properties.

Another object of the present invention is to provide filaments and fibers having high moisture absorptivity and antistatic property which can be used in fabrics for preparing apparel and other articles.

A still further and specific object of the present invention is to provide light weight abrasion resistant and antistatic panty hose and stockings which incorporate textile fibers fabricated from high molecular weight cross-linked linear homopolymers such as polyacrylic acid and poly(hydroxyethylmethacrylate) which do not lose their textile characteristics such as tensile strength when tested in wet condition.

These and other objects of the present invention which will become apparent from the following description are generally accomplished by incorporating in a fabric at least about 1% by weight of a novel specialty fiber which is formed from a linear hygroscopic hompolymer having only carbon to carbon bonds in the polymer backbone with hydrophilic side chains in the repeating recurring units, the polymer being formed from a monomer selected from the group consisting of alpha, beta-ethylenically unsaturated aliphatic carboxylic acids, alpha, beta-ethylenically unsaturated aliphatic sulfonic acids, hydroxyalkyl esters of these aliphatic carboxylic and sulfonic acids, and glycidyl esters of these aliphatic carboxylic and sulfonic acids, such polymers having a molecular weight in the range of from about 100,000 to about 500,000, a softening point in the range of from about 210° C. to about 245° C. and a glass transition temperature Tg above about 115° C. the homopolymers being cross-linked at a cross-linking density in the range of one cross-linkage per from about 40 to about 100 repeating monomeric units of the homopolymer. These specialty textile fibers are capable of absorbing up to about 40% by weight of the fiber of moisture without loss of mechanical strength and other textile properties and are further characterized by having a Rockwell hardness in the range of about 40 to about 60.

In accordance with the present invention, any of these specialty fibers may be assembled or fabricated into various types of fabrics including those involving interlocked yarns or threads formed of plied yarns and those of felt-like character in which the fibers or filaments are interlaced or interlocked with or without being adhesively bonded at their points of intersection or interlocking. The former type of fabric may be a woven, knitted, netted, knotted, or braided fabric formed of yarns comprising fibers or filaments of the type specified. Non-woven fabrics contemplated by the present invention are also obtainable by the haphazard distribution of a multiplicity of fibers either of short lengths or of continuous length. This includes such fabrics as are obtained by carding, and if desired, superimposing a plurality of carded webs upon one another with the machine direction of the various webs disposed either parallel to one another or at various angles for the purpose of providing either anisotropy or isotropy in the characteristics of the resulting fabric, particularly as to strength and cleavage. Intermediate forms, which may also be termed hybrid forms, of fabrics may be involved such as the type of fabric known as needle felts wherein a woven or knitted fabric has fibers or filaments punched through the woven base fabric.

The various fabrics may be formed entirely of fibers, filaments, and yarns of the type defined above, but preferably, they comprise a blend of fibers or filaments of this type with fibers or filaments of other types, either natural or artificial in origin. Similarly, the fabrics may be formed of a mixture of yarns comprising fibers or filaments of the type defined above with yarns formed of other fibers, either natural or artificial. Thus, the fabrics may also comprise fibers, filaments, or yarns of cotton, wool, silk, linen, nylon, polyethylene terephthalate (e.g. Dacron), regenerated cellulose rayons, cellulose acetate, casein, vinyl resin fibers, such as copolymers of vinyl chloride and vinyl acetate or acrylonitrile, and especially polyesters, polyacrylonitriles, and polyamides. The proportion of fibers, filaments, or yarns formed of the cross-linked high molecular weight hygroscopic homopolymers in the fabrics may vary widely from 1 to 100%. However, a proportion of 1 to 10%, especially 2 to 10% by weight has been found to be entirely adequate in modifying the resistance to static electricity without adversely effecting the mechanical and textile properties of the fabric, such as tensile strength, modulus of elasticity, hand or feel, etc.

Fabrics in which there may be a reinforcing element to improve the strength of the fabric, for example, a glass yarn woven at intervals through a woven fabric comprising the yarns formed of fibers of the present invention arranged in alternate relationship with the glass-fiber or filament yarns are also within the scope of the invention.

An essential feature of the fabrics of the invention is that they comprise at least about 1%, preferably at least 2%, especially from 2 to 10% by weight of the fabric, of fibers, filaments or yarns formed of the cross-linked high molecular weight hygroscopic linear homopolymers of the ethylenically unsaturated carboxylic or sulfonic acid, or the hydroxyalkyl esters or glycidyl esters thereof.

The filaments, fibers or yarns and fabrics formed thereof may be subject to other customary finishing processes, such as crimping, curling, twisting, sizing, softening, or lubricating to faciliate weaving, knitting and other textile operations.

The filaments, threads or yarns produced by the above described procedural steps are useful in the preparation of various types of fabrics. However, they are especially useful in the preparation of lightweight and sheer type fabrics such as used in the fabrication of garments, especially intimate apparel, e.g. undergarments including underwear, undershirts, stockings, panty hose, and the like.

While fibers and filaments of this invention may be used together with all natural and sythetics, blends with nylons, polyacrylics and polyester are especially preferred for sheer fabrics. In the case of continuous filaments and yarns for stockings, panty hose, etc., the filaments may be co-twisted with the other components of the fabric. In the case of nylons which have a moisture regain between 3.2 and 3.7% about 2 to 4 weight percent of the specialty fibers are sufficient to arrive at a conductivity of more than $10^{-10}$ reciprocal ohms. It is generally agreed that above $10^{-10}$ reciprocal ohms there are no static charge difficulties.

If the bulk of the textile material in the fabric consists of, for example, acrylics or polyesters, which possess a much lower moisture regain, for example between 0.4 and 0.8%, it has been found that up to 10%, preferably from about 4 to 10% of the specialty fibers should be added in order to render the conditioned fabric sufficiently conductive to avoid any noticeable static inconveniences. In the case of spun yarns as in underwear, shirts, etc., the specialty fibers of the invention are blended with the other, predominant component in the form of staple fibers in appropriate proportions to obtain the desired value of electrical conductivity.

The relatively small amount of conducting filament or fiber, for example, about 2 to 10%, has practially no influence on the mechanical properties of the yarns and fabrics of the final textile article.

In particular, fabrics especially suitable for fabrication into intimate apparel include woven, non-woven or knitted fabrics weighing less than 2 grams per square foot, have a tensile modulus of at least 30 grams, based on 1 denier cross-section of the fabric, a tensile strength of at least 3 grams, also based on 1 denier cross-section of the fabric, an elongation at break of at least 30%, a moisture absorptivity in the range of from about 30 to about 50% by weight of the dry fabric, and an electric conductivity of at least $10^{-10}$ (ohms cm)$^{-1}$; these fabrics containing from 2 to 10% by weight of the fabric of the novel specialty fiber according to the invention.

These fabrics are particularly useful in the preparation of articles of apparel, especially undergarments, panty hose and stockings and are antistatic, comfortable and abrasion resistant, and retain their mechanical, thermal, electrical, and physiological properties even after having absorbed as much as 35% to 40% or more, of their dry weight, of moisture.

The present invention is based in part on the observation that cotton and other natural cellulosic fibers such as hemp, flax and ramie have a relatively high moisture equilibrium content (up to about 15%) yet do not lose any textile strength when tested in the wet condition. On the other hand, all viscose rayons at an average moisture content between 10 to 12% lose up to 70% of their tensile strength in the wet state. It is believed that this discrepancy can be largely attributed to the substantially higher molecular weights and crystallinity of the native cellulosic fibers. For instance, the molecular weights of the cellulose fibers are more than 10 times that of the rayons and the degree of crystallinity is up to about 95% higher.

In order to produce synthetic fibers having a high moisture absorptivity up to about 50% moisture regain, which is the amount necessary to provide significant improvements in the fabrics used to produce apparel such as undergarments and the like, it is necessary to use synthetic polymeric materials having molecular weights of at least about 100,000 and up to about 500,000. However, for such high molecular weight polymeric materials having hydrophilic groups attached to the polymer backbone, the irregular conformation of the highly hygroscopic chains makes it impossible to obtain high degrees of crystallinity. Accordingly, in the present invention cross-linking of polymer chains is substituted for crystallinity of the natural cellulosic materials in order to provide the same high strength characteristics of the naturally crystalline fibers.

In addition to having a high molecular weight capable of providing the required mechanical characteristics, including modulus, tensile strength, elongation etc., of a textile fiber, the polymer materials used in the present invention must be capable of providing fibers which satisfy the following additional requirements:

(a) moisture regain, i.e. ability to absorb up to about 40% by weight of moisture without degradation of textile properties;

(b) antistatic property, i.e. a surface resistance of less than $10^{10}$ ohms;

(c) resistance against laundering and dry cleaning, i.e. must withstand repeated laundering and/or dry cleaning cycles of up to 25 times or more, without loss in mechanical properties, fading, etc.;

(d) resistance against atmospheric influences, i.e. must withstand light, oxygen, ozone, acidic impurities, and the like without loss in mechanical properties, fading, etc.

Fabrics containing as little as 10% by weight of the specialty fibers of the present invention satisfy all of the foregoing requirements while at the same time providing the requisite degree of comfortableness, abrasion-resistance and antistatic properties essential in articles of apparel, especially ladies undergarments, panty hose, stockings, and the like.

The filaments or fibers of the present invention are obtained by cross-linking very thin filaments or fibers of the linear hygroscopic homopolymers of the alpha, betaethylenically unsaturated aliphatic carboxylic acids, alpha, beta-ethylenically unsaturated sulfonic acids, the hydroxyalkyl esters of these acids and the hydroxyglycidyl esters of these acids; the useful homopolymers have molecular weights of at least 100,000, especially 100,000 to 500,000, most preferably from about 150,000 to about 400,000.

Generally, monomers having from 1 to 10 carbon atoms, preferably from 1 to 6 carbon atoms, can be used. Examples of the alpha, beta-unsaturated aliphatic carboxylic acids include crotonic acid, acrylic acid, methacrylic acid, ethacrylic acid, alpha-isopropylidene acrylic acid, alpha-vinyl acrylic acid and the like. Of these, acrylic acid and methacrylic acid are preferred. Polyacrylic acids having molecular weights up to 500,000 and more are commercially available and are particularly preferred for use in the present invention.

As examples of the ethylenically unsaturated aliphatic sulfonic acids, any of the foregoing carboxylic acids in which the carboxylic (—COOH) group is substituted by the sulfonic acid (—$SO_3H$) group can be used. Preferred examples of the olefinically unsaturated sulfonic acids include vinyl sulfonic acid, p-styrene sulfonic acid.

The hydroxyalkyl esters of these aliphatic carboxylic and sulfonic acid esters may have from 1 to 3 hydroxyl groups, preferably 1 or 2 hydroxyl groups and most preferably 1 hydroxyl group. The alkyl moiety of the hydroxyalkyl esters may have from 1 to 8, preferably from 1 to 4 carbon atoms. Examples of the hydroxyalkyl esters include, for example, 2-hydroxyethylacrylate, 2-hydroxypropylacrylate, 3-hydroxypropylacrylate, 4-hydroxybutylacrylate, 5-hydroxypentylacrylate, 2-hydroxyethylmethacrylate, 2-hydroxypropylmethacrylate, 3-hydroxypropyl-methacrylate, 4-hydroxybutylmethacrylate and the hydroxyacrylates and hydroxymethacrylates of the corresponding sulfonic acids. Of these, hydroxyethylmethacrylate is the preferred monomer and poly(hydroxyethylmethacrylate) in high molecular weight is readily commercially available.

As examples of the hydroxyglycidyl esters of the aliphatic carboxylic and sulfonic acids mention can be made of, for example, the hydroxyglycidyl esters of acrylic acid, crotonic acid, vinyl sulfonic acid and p-styrene sulfonic acid.

In order to prepare the fine textile mono-filaments to deniers of 7 or less from these linear hygroscopic polymers, the polymers are wet spun before being cross-linked in order to permit uninhibited laminar flow through the spinneret. This can be readily accomplished by preparing an aqueous spinning solution of the polymer, in the state of a sol, with a solids concentration, depending on the molecular weight of the polymer, of from about 5 to about 35%, preferably from about 15 to 25% by weight. The spinning solution can be coagulated in an aqueous salt solution which withdraws water from the polymer filament through the osmotic action of the salt. This converts the polymer sol into a non-cross-linked gel which can be reversibly reconverted back into a solution. The gelatinous filaments in which the individual macromolecules are held together only by van der Waal forces or hydrogen bonds can be oriented by stretching to any desired degree. After this stage is reached, the filaments are transferred into a second bath containing a cross-linking agent where the filaments are cross-linked by the action of covalent chemical bonds.

The preparation of artificial and synthetic filaments from spinning solutions of non-cross-linked polymeric material followed by spinning, stretching and cross-linking is generally known in the art. Suitable procedures which can be adapted for the high molecular weight linear hygroscopic polymers used in the present invention are disclosed, for example, in U.S. Pat. Nos. 3,140,265 and 3,733,386.

In a preferred procedure, the polymer material, in the form of a fine powder, is introduced into the necessary quantity of distilled water and gently stirred until complete dissolution is effected. Depending upon the molecular weight of the polymer, the concentration of the spinning solutions ranges between 5–35% with a preferred range between 15–25%. In order to obtain smooth spinning the absolute viscosities of the spinning solutions should be between 20–2000 poises measured at 20° C. Within this range of spinning solution viscosities, spinning speeds between 80–200 yarns/min. can be obtained. The spinning solution must be deaerated and carefully filtered. Deaeration can be carried out under vacuum while the solution is slowly passing through a disc-shaped vessel. Filtration can be performed with the aid of candle filters similar to those used in the viscose rayon process. Since the spinning solutions are substantially neutral (between 6.5–7.2), woven or non-woven fabrics of cotton or rayon can be used for filtration. After filtration, the solution which has a viscosity preferably between 100 and 300 poises is pumped to the spinnerette, preferably using tooth wheel pumps since they do not permit any air to enter the spinning solution. Satisfactory results are obtained with spinnerettes with 40 to 72 holes each with a diameter of about 0.080 mm. It is also advantageous to use a countersink having about one-half the length of the canal of the spinnerette.

It is also possible to prepare staple fibers from spinnerettes having 4,000 holes with otherwise the same design and dimensions.

The spinning bath is maintained in the range between 25°–45° C. and consists of a neutral or acidic salt solution; for example, $NH_4Cl$ in the concentration range of about 15–20% and $Na_2SO_4$ in the concentration range of about 15–20% have given satisfactory results. As known from the spinning of viscose rayon the cross sections of the filaments are affected by the chemical character and concentration of the bath. In order to arrive at desired cross sections it has been advantageous to add $H_2SO_4$ in the range of between about 0.5 to 10% to the spin bath.

As the threads enter the bath they are dehydrated by the osmotic pressure and transformed into a stretchable gel. They are led over a first roller and then at a distance of, for example, about 2.5 meters over another roller, the surface velocity of which is faster than that of the first roller, for example, about 2.5X to effect stretching and molecular orientation. As a result of this stretching, the individual macromolecules are parallelyzed and extended and to a certain extent glide along each other, because at that time they are not yet cross-linked by chemical bonds. After emerging from the end of the first bath, the filaments are led into a second bath in which they are cross-linked by chemical bonds. One efficient way of cross-linking is to have the second aqueous bath contain a water soluble cross-linking agent which is capable of being absorbed by the gel filament as it passes through the second bath. Such bifunctional cross-linking agents include, for example, dicarboxylic acids or anhydrides, glycols, or diamines, or other bifunctional reactive compounds. The cross-linking reaction takes place in the second bath either thermally (40°–50° C.) or under the influence of a catalyst. After emerging from the second bath at a speed 100–150 yards/min the filaments are dried in any commonly known fashion and wound up on a spool.

The cross-linking step can be affected without chemical agents simply by exposing the filaments either to the action of ionizing radiation or fast electrons. In this case, there is no second bath necessary and the filaments are exposed to the irradiation while they are being wound up on the spool.

The invention will now be described by the following non-limiting examples.

EXAMPLE 1

A solution of polyacrylic acid with a MW of 260,000 is prepared in distilled water with a concentration of 18.5% polymer at 40° C. The solution is deaerated in a vacuum system for 24 hours and then with the aid of a toothwheel pump is conducted through a candle filter to a spinnerette having 40 holes each with a diameter of 0.080 mm. This solution is extruded into a bath containing 6% $NH_4Cl$, 11% $MgSO_4$, and 1.2% $H_2SO_4$ at 40° C. The gel filaments which form immediately upon contact of the solution with the bath are conducted through it over a distance of about 18 feet, while being supported by glass rolls, back and forth at a speed of 75 yards per minute. At the end of this coagulation period, the filaments are led through a second bath which contain 2.5% ethylene diamine and 12% $NH_4Cl$ in water. Through the action of the ethylene diamine which gradually penetrates into the gel filaments covalent cross-linking is established between the individual molecules of polyacrylic acid and a water insoluble highly swollen filament bundle is obtained. The length of the cross-linking bath is 18 feet and the threads are conducted back and forth through it with the aid of glass rolls at a speed of 90 feet per minute resulting in cross-linked filaments having one chemical cross-link (transversal covalent bond) per each 50 to 60 monomer units of the polymer chain.

After this treatment, the filament bundle is washed in a third bath of distilled water for a period of about three minutes. The filaments are then wound up and dried with warm air. The total cross-section of the fiber bundle has a denier of 160 corresponding to about 4 denier per filament, an air dried tensile strength of 2.5 g/den, and an elongation at break of 40%. These filaments are capable of absorbing up to 45% by weight of water when immersed in a bath of pure water at 25° C. without losing their coherence and tensile characteristics.

EXAMPLE 2

The procedure of example 1 is repeated except that the molecular weight of the acrylic acid polymer is increased to 300,000; in the spinning bath the gel filaments which are formed are conducted over the glass rolls at a reduced speed of 23 yards per minute and in the cross-linking bath the speed is reduced from 90 feet per minute to 69 feet per minute; and the filaments are washed for 10 minutes in the third bath of distilled water.

The resulting filaments have the same properties as in Example 1.

EXAMPLE 3

A 22.5% solution of poly(hydroxyethylmethacrylate) with a MW of 185,000 is prepared by dissolving the dry powdered polymer in water at 25° C. The solution is deaerated by keeping it in a vacuum container at 40° C. for 24 hours and is conducted with the aid of a toothwheel pump to a spinnerette having 72 holes each with a diameter of 0.080 mm. The solution is extruded into an aqueous bath which contains 2.5% $Na_2SO_4$, 5% $MgSO_4$ and 2.5% $H_2SO_4$ with a speed of 60 feet per minute. Immediately after entrance into the bath, the filaments coagulate into a gel which is stretched by a factor of 1.25 and kept in the bath over a distance of 12 feet while being conducted back and forth on glass rolls. The coagulated filaments are then led into another bath which contains 8% $MgSO_4$ and 5% oxalic acid. The temperature of this bath is maintained at 60° C. The filaments travel with a speed of 12 feet per minute and for a total distance of 18 feet.

Under the influences of oxalic acid cross-linking occurs and the filaments are covalently reticulated and become insoluble in aqueous systems.

After being washed, the filaments are dried and have 3.5 denier per filament, tensile strength of 2.8 grams per denier and elongation to break of 28%.

The yarns made of these filaments are capable of absorbing up to 38% moisture without losing any of their valuable textile characteristics.

EXAMPLE 4

When Example 3 is repeated except that the poly(hydroxyethylmethacrylate) has a molecular weight of 260,000, the extruded gel filaments travel through the coagulation bath over a distance of about 40 feet by being conducted back and forth over glass rolls while still being stretched by a factor of 1.25, and in the second bath containing the oxalic acid cross-linking agent and magnesium sulfate the filaments travel at a speed of about 12 feet per second over a distance of about 18 feet.

The resulting filaments have the same properties as in Example 3.

EXAMPLES 5-8

Yarns are prepared by cotwisting either 4% or 10% by weight of the fibers of Example 2 with polyethylene terephthalate fibers or nylon fibers and the properties of the yarns are measured. As a control, the properties of the polyethylene terephthalate yarns and nylon yarns without addition of the hydrophilic fibers of the invention are also measured. The results are shown in the following table:

TABLE

| | Yarn with no addition of hydrophilic fiber | | Yarn with addition of hydrophilic fiber of Example 2 | | | |
|---|---|---|---|---|---|---|
| | | | 4% | | 10% | |
| Property | Nylon | PET | Nylon | PET | Nylon | PET |
| Elastic modulus in g/cm | 30 | 70 | 30 | 68 | 28 | 64 |
| Tensile strength in g/den | 4.5 | 4.7 | 4.5 | 4.7 | 4.2 | 4.2 |
| Elongation at break in % | 32 | 28 | 36 | 30 | 38 | 34 |
| Elastic range of elongation in % | 12 | 8 | 13 | 9 | 15 | 11 |
| Creep at 30% of breaking load in % | 6 | 4 | 6 | 5 | 8 | 7 |

As can be seen from the foregoing examples, the cross-linked hydrophilic fibers of this invention have outstanding physical properties in addition to their advantageous chemical and antistatic resistance properties. For example, the specialty fibers of this invention are characterized by a Young's Modulus of at least 8 grams per denier and accordingly, these fibers can be blended with conventional textile fibers such as polyesters, polyamides, acrylics and the like without impairing the mechanical strength properties of the fabrics prepared from these fiber blends.

Moreover, while fabrics containing only 1 to 10% of the specialty fibers of the invention are especially suitable in such application as articles of apparel, bedding, industrial fabrics and the like, fabrics containing substantially larger amounts of the specialty fibers, for example at least 20% by weight, especially at least 50% by weight, can be successfully used in applications where stress, stretching and the like are not anticipated, for example, as bandages for burns where the hydrophilic property is of great importance.

What I claim is:

1. A textile fabric which is resistant to accumulation of static charge, said fabric comprising at least one percent by weight of interlocked hydrophilic fibers which are capable of absorbing up to about 50% by weight of the fiber of moisture without lose of mechanical strength and other textile properties, said hydrophilic fibers having a Rockwell hardness in the range of from about 40 to about 60 and consisting of a linear hygroscopic homopolymer of a monomer selected from the group consisting of alpha, beta-ethylenically unsaturated carboxylic acids, alpha, beta-ethylenically unsaturated sulfonic acids, hydroxyalkyl esters of these acids and hydroxyglycidyl esters of these acids, said polymers having a molecular weight in the range of from about 100,000 to about 500,000, a softening point in the range of from about 210° C. to about 245° C. and a glass transition temperature Tg above about 115° C., and said polymer being cross-linked at a cross-linking density in the range of one chemical cross-link bond per from about 40 to about 100 repeating monomeric units of said polymer.

2. The fabric of claim 1 which comprises from 2 to 10% by weight of the fabric of said hydrophilic fibers.

3. The fabric of claim 2 wherein said hydrophilic fibers consist of cross-linked polyacrylic acid.

4. The fabric of claim 2 wherein said hydrophilic fibers consist of crosslinked poly(hydroxyethylmethacrylate).

5. The fabric of claim 1 wherein said monomer is selected from the group consisting of acrylic acid, methacrylic acid, crotonic acid, hydroxyethyl methacrylate , hydroxyethylacrylate, hydroxypropylacrylate, hydroxybutylacrylate, hydroxypentylacrylate, hydroxypropylmethacrylate and hydroxybutylmethacrylate.

6. The fabric of claim 2 which comprises from 90 to 98% by weight of additional textile fibers selected from the group consisting of polyester fibers, polyamide fibers and polyacrylonitrile fibers, or mixtures thereof.

7. The fabric of claim 6 wherein said fabric weighs less than 2 grams per square foot, has a moisture absorptivity in the range of from about 30 to about 50 and has an electron conductivity of at least $10^{-10}$ reciprocal ohms.

8. As an article of apparel, an undergarment which is worn in contact with the human anatomy, said undergarment being fabricated from the fabric of claim 1.

9. The article of apparel of claim 8 which is panty hose.

10. The article of apparel of claim 8 which is stockings.

11. The article of apparel of claim 8 which is underwear.

12. As an article of apparent, panty hose comprising the fabric of claim 7.

13. The article of apparel of claim 12 wherein said hydrophilic fibers consist of cross-linked polyacrylic acid or cross-linked poly(hydroxyethylmethacrylate).

14. As an article of apparel, stockings comprising the fabric of claim 7.

15. The article of apparel of claim 14 wherein said hydrophilic fibers consist of cross-linked polyacrylic acid or cross-linked poly(hydroxyethylmethacrylate).

16. As an article of apparel, underwear comprising the fabric of claim 7.

17. The article of apparel of claim 16 wherein said hydrophilic fibers consist of cross-linked polyacrylic acid or cross-linked poly(hydroxyethylmethacrylate).

* * * * *